US006478248B2

(12) United States Patent
Liu

(10) Patent No.: US 6,478,248 B2
(45) Date of Patent: Nov. 12, 2002

(54) HANDLE FOR ROLL CORE

(76) Inventor: An-Hsia Liu, 4821 Spencer St., Torrance, CA (US) 90503

( * ) Notice: Subject to any disclaimer, the term of this patent is extended or adjusted under 35 U.S.C. 154(b) by 0 days.

(21) Appl. No.: 10/060,729

(22) Filed: Jan. 28, 2002

(65) Prior Publication Data

US 2002/0070310 A1 Jun. 13, 2002

Related U.S. Application Data

(63) Continuation-in-part of application No. 09/772,398, filed on Jan. 29, 2001, now abandoned.
(60) Provisional application No. 60/179,382, filed on Jan. 31, 2000.

(51) Int. Cl.[7] ..... B65H 16/06; B65H 75/24
(52) U.S. Cl. ..... 242/571.4; 242/571.5; 242/588.2
(58) Field of Search ..... 242/571.4, 571.5, 242/613.5, 588, 588.1, 588.2, 597.6

(56) References Cited

U.S. PATENT DOCUMENTS 1,812,421 A * 6/1931 Wickware ..... 242/613.5
1,825,822 A * 10/1931 Rundell ..... 242/571.5
2,988,032 A * 6/1961 Voissem ..... 242/613.5
4,372,500 A * 2/1983 Saraisky ..... 242/588.1
4,600,163 A * 7/1986 Hummel et al. ..... 242/588
5,480,106 A * 1/1996 Voissem ..... 242/613.5
5,524,835 A * 6/1996 Collins ..... 242/597.6
5,570,564 A * 11/1996 Moore et al. ..... 242/571.4
5,915,642 A * 6/1999 Davis ..... 242/571.5
5,961,063 A * 10/1999 Parry ..... 242/588
6,123,285 A * 9/2000 Border et al. ..... 242/571.4

* cited by examiner

*Primary Examiner*—John M. Jillions
(74) *Attorney, Agent, or Firm*—Raymond Y. Chan; David and Raymond Patent Group

(57) ABSTRACT

A roll core is adapted for fitting into an open end of a roll core for supporting said roll core while said roll core is capable of rotating with respect to said handle. The handle includes a hollow holder body having a plurality of side-by-side side wall arcuate segments and a plurality of stiffening ribs formed longitudinally around the holder body, wherein the stiffening ribs are positioned spacedly apart to separate the plurality of arcuate segments into groups of resilient rotor supports adapted for compressive constraint within said roll core for enabling the roll core to be smoothly rotated with respect to the holder body. The handle further includes a flange radially and outwardly extended from a proximal end of the holder body integrally.

23 Claims, 5 Drawing Sheets

HANDLE FOR ROLL CORE

CROSS REFERENCE OF RELATED APPLICATION

This is a Continuation-In-Part application of a non-provisional application having an application number of 09/772,398 and a filing date of Jan. 29, 2001, now abandoned which is a regular application of a provisional application having an application number of 60/179,382 and a filing date of Jan. 31, 2000.

BACKGROUND OF THE PRESENT INVENTION

1. Field of Invention

The present invention relates generally to roll core holders, and more particularly to a disposable handle adapted for insertion into an open end of a film dispensing roll.

2. Description of Related Arts

A roll core is made of compressed paper stock or plastic. It is used to wind up plastic, metal and paper sheets into rolls. These sheet materials are subsequently dispensed from the rolls. Rolls of this sort may be supported on a core chuck or similar equipment whereby the roll goods are pulled from the roll core by revolving the core on the core chuck. This may be a mechanized or manual operation. In some cases the roll goods is dispensed by simply holding the roll core and pulling the sheet roll goods from the roll core. This is difficult and can cause burns as the roll slips in the hands of one holding the core.

The following cited references teach that a manually held support can be used with a core for the dispensing step that defines the present state of this field:

Parry, U.S. Pat. No. 4,179,081, describes an improved apparatus for the manual application of plastic stretch films to materials and items to be packaged and secured as a unit or packaged and secured to a shipping and transporting means. The apparatus consists of an extended core for the supply of plastic stretch film and a pair of tubular-like grip means for said extended core. Said grip means serving as a manual control means for the speed of paying out the plastic stretch film material, and as a manual means for applying for applying tension on the film during the course of applying it to materials lo and items.

Parry, U.S. Pat. No. 4,248,392, describes an improved apparatus for the application of plastic stretch film to materials and items to be packaged and secured as a unit or packaged and secured to a shipping and transporting means. The apparatus consists of a pair of insertable adapters for the ends of a cylindrical core which holds a supply of plastic stretch films and a pair of tubular-like grip means for said insertable adapters. The grip means serves as a control means for the speed of paying out the plastic stretch film material, and as a means for applying tension on the film during the course of applying it to materials and items. The apparatus may be used for manual or machine application of film to materials. Brake shoe equivalents of the grip means may be used for machine applications.

Parry et al., U.S. Pat. No. 4,722,493, describe a holder for dispensing stretch film from a roll comprising a cylindrical body and an arbor rotatably supported on the body. A flexible grip having internal ribs covers the body and the arbor, so that one can, by applying finger pressure to the grip, brake rotation of the arbor and thus control film tension.

Hummel et al, U.S. Pat. No. 4,600,163, teach apparatus for controlled manual unrolling of rolled flexible material, which is not suitable for the user to rotatably hand-support directly by his or her fingers.

Saraisky, U.S. Pat. No. 4,372,500, teaches inserts for use with web dispensing means, which contains the following drawbacks.

(a) The insert must have a diameter fittingly for rotatably inserting into the respective end opening of the roll core. The inserts have no way to mount at two ends of the roll core even when the inner diameter of the end opening of the roll core is just slightly smaller than the outer diameter of the inserts.

(b) If the inserts are made in tapered shaped, as shown in FIG. 6 of the cited art, so that they are able to stack one inside the other and may fit to insert roll cores with various inner diameters, the insert would be stuck in the end opening of the roll core, when the user pushes too hard inwardly while supporting the web roll, that would block the rotation of the web roll with respect to the inserts. At this moment, the heavy web roll as well as the inserts would rotate with respect to the supporting hands of the user that may hurt and burn the user's fingers.

(c) Theoretically speaking, the user may hand-support the inserts by inserting the user's fingers into the two hollow cavities of the two inserts respectively. However, since the three undulations 14*b*-1 to 14*b*-3, which are spacedly and longitudinally positioned around the inserts, are just slightly projected outwards, the wall of the insert is unavoidably in contact with the interior surface of the roll core, as shown in FIG. 5 of the cited art, especially when the user's fingers pressing against the wall of the insert outwardly that may burn the user's fingers due to the frictional heat generated between insert and the roll core.

In view of above, the prior art teaches the use of roll core holders but do not teach a relatively flimsy cylindrical handle held within a roll core at either end by compressive elastic material bias. Moreover, when the roll core holders are used as handles, the roll is directly supported by the user's fingers which are inserted into the holders, none of the conventional arts suggest how to prevent the user's holding fingers from burning heat due to the direct frictional contact of the circular wall of the holder and the inner surface of the roll core. The present invention fulfills these needs and provides further related advantages as described in the following summary.

SUMMARY OF THE PRESENT INVENTION

The present invention teaches certain benefits in construction and use which give rise to the objectives described below.

A primary objective of the present invention is to provide a disposable handle for roll cores that provides advantages not taught by the prior art described above.

Another objective of the present invention is to provide a very low manufacturing cost roll core handle which is effective and may be discarded after use.

Another objective of the present invention is to provide a disposable roll core handle which is capable of being produced at low cost.

Another objective of the present invention is to provide a disposable roll core handle which is capable of compressing into a roll core and this providing support while the roll core is rotated.

Another objective of the present invention is to provide a disposable roll core handle which is capable of being formed from a flat strip and rolled into a cylinder for use as a handle for the user to support the film roll directly by his or her hands.

Another objective of the present invention is to provide a pair of disposable handles for roll cores, which provide a smoother rotation of the roll core with respect to the handles with less friction and heat generated therebetween.

Another objective of the present invention is to provide a disposable handle for roll cores, which is constructed to avoid heat transferred to the user's hand and fingers directly by providing an inner finger-holder portion, which has substantial contact with the inner surface of the roll core, for the user's fingers to support thereon.

Another objective of the present invention is to provide a disposable handle for roll cores, which holder body is equipped with a spring effect to absorb pressure and vibration formed during the rotation of the film roll so as to avoid unwanted injury to the finger joints of the user's hands that support the roll core through a pair of the disposable handles.

Another objective of the present invention is to provide a disposable handle for roll cores, which can be fitted to roll cores with various inner diameters, for example from 2.989 inches to 3.060 inches.

Another objective of the present invention is to provide a disposable handle for roll cores, which can prevent the flange of the handle from rubbing or scratching against the respective end side of the film roll that may block the rotation of the film roll.

Another objective of the present invention is to provide a disposable handle for roll cores, which incorporates reinforcing arrangement both in the flange and the holder body that minimizes the thickness of the handle so as to lower the manufacturing cost as much as possible.

In order to accomplish the above objectives, the present invention provides a pair of low cost handles with every roll of goods that is shipped without driving up the cost of the commercial product.

The present invention provides a single or pair of disposable handles. For a short length roll core, a single handle may be used. For longer roll cores, a pair of the handles is necessary. Each of the handles comprises a holder body having a circular side wall, which has a plurality of side wall arcuate segments spacedly and longitudinally arranged around the holder body and a plurality of stiffening ribs each longitudinally and inwardly extended between two of the arcuate segments. The holder body is adapted for compressive constraint when inserted into an end of the roll core so as to provide an outward spring bias deflection for gripping the roll core interiorly. The two handles, then, are placed in two ends of the roll core respectively. The arcuate segments may be axially oriented or circumferentially oriented. The stiffening ribs provided on the holder body of the handle in a spaced-apart and axially-directed manner are used to apply finger pressure to prevent the handles from revolving with the roll core. The roll core is supported by the one or two handles which allow the film to be dispensed from the film roll as the film roll rotates about the stationary handle(s).

Other features and advantages of the present invention will become apparent from the following more detailed description, taken in conjunction with the accompanying drawings, which illustrate, by way of embodiments, the principles of the invention.

BRIEF DESCRIPTION OF THE DRAWINGS

The accompanying drawings illustrate the present invention.

DETAILED DESCRIPTION OF THE PREFERRED EMBODIMENT

The above described drawings illustrate the present invention in a preferred embodiment and its several alternative modes, which are further defined in detail in the following description.

Figure 7:
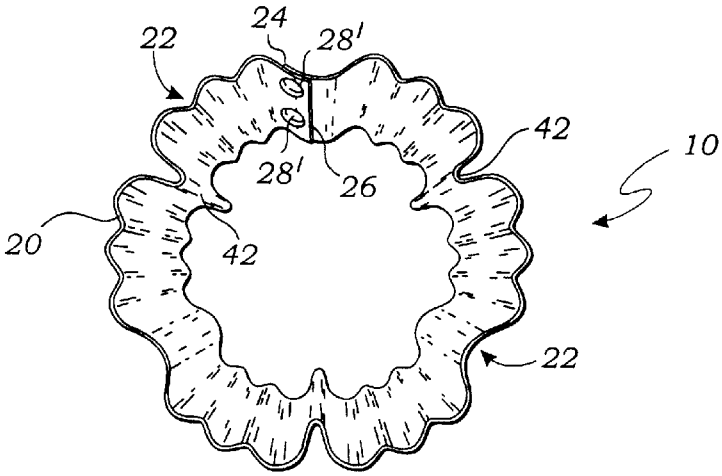
FIG. 7 is an end elevational view of the disposable handle as shown in FIG. 6, wherein the disposable handle is rolled into a cylinder body with seam fastened.
Figure 8:
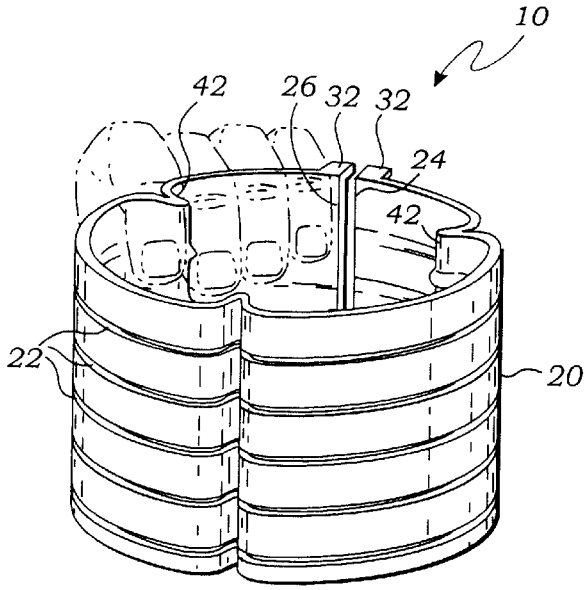
FIG. 8 is a perspective view of a disposable handle for roll cores according to a fifth. preferred embodiment of the present invention, having circumferential segments encircling the side wall of the holder body.
Figure 9:
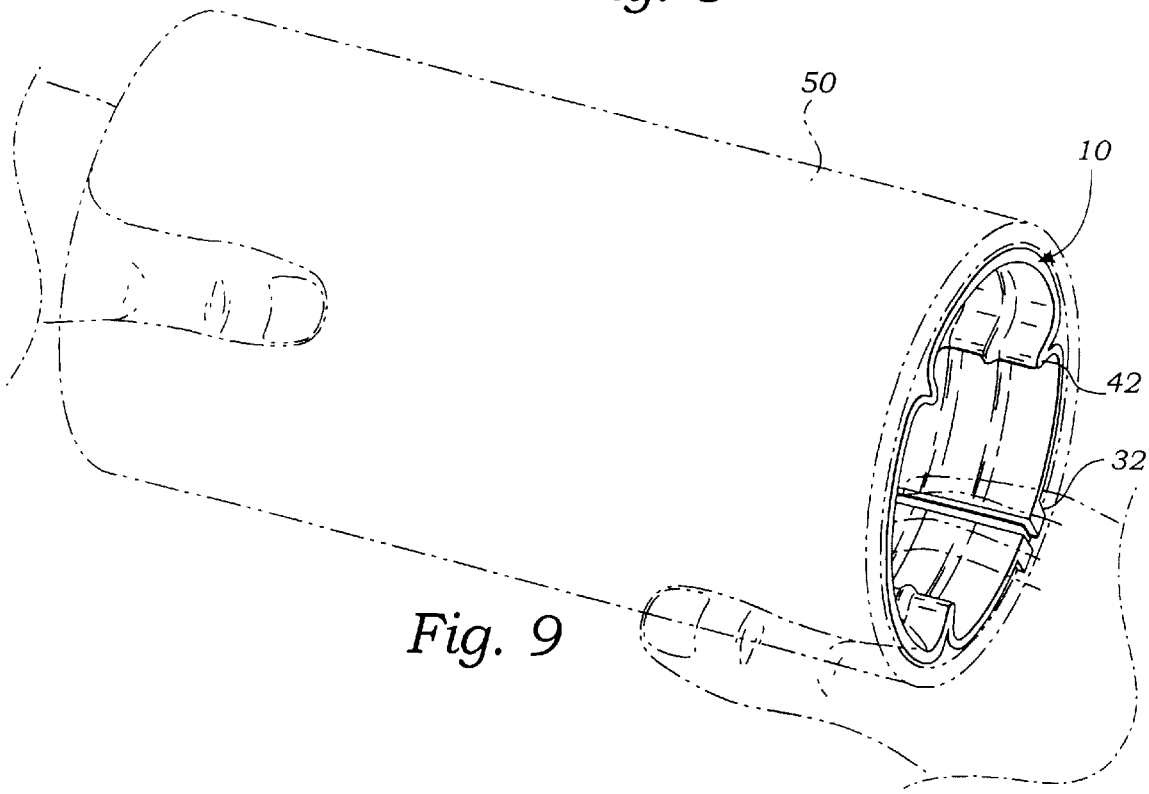
FIG. 9 is a perspective view of a roll of goods with the disposable handle as shown in FIG. 8 inserted in one end.

A roll core 50 (not a part of the invention) is supported by one or a pair of cylindrical handles 10 preferably made of thin-wall plastic. Such roll cores are made of paper or plastic and are simple tubes with open ends. The handles 10 may be formed by injection molding, vacuum forming or spin molding. Each handle 10 is an integral, one-piece part providing a hollow holder body 20 which is a generally circular side wall having a plurality of side-by-side side wall arcuate segments 22 formed thereon adapted for compressive constraint within the roll core 50 and derives from such compressive constraint, an outward spring bias deflection which is used for gripping the roll core 50 interiorly at one of its ends. In compressing, each of the arcuate segments 22 flex to form a smaller curvature of arc, thereby diminishing the overall outside diameter of the holder body 20. Two handles 10 are placed in two ends of the roll core 50 respectively for the user to use both hands to manually grip to support the roll core 50 while the roll core 50 is rotated for unwinding the film previously wound on the roll core 50. It is best seen in FIG. 9. The arcuate segments 22 may be axially oriented as shown in FIG. 7 or circumferentially oriented, as shown in FIG. 8. The holder body 20 further provides a plurality of spaced-apart, axially-directed stiffening ribs 42.

Figure 1:
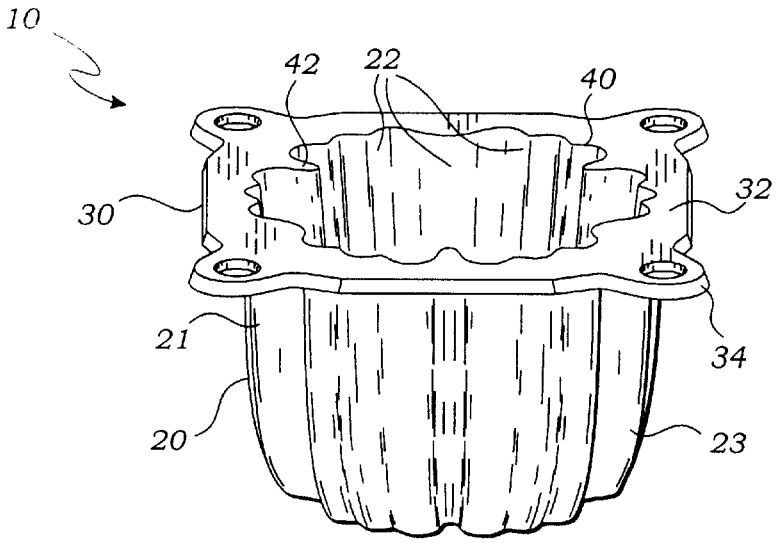
FIG. 1 is a perspective view of a disposable handle for roll cores according to a preferred embodiment of the present invention.
Figure 2:
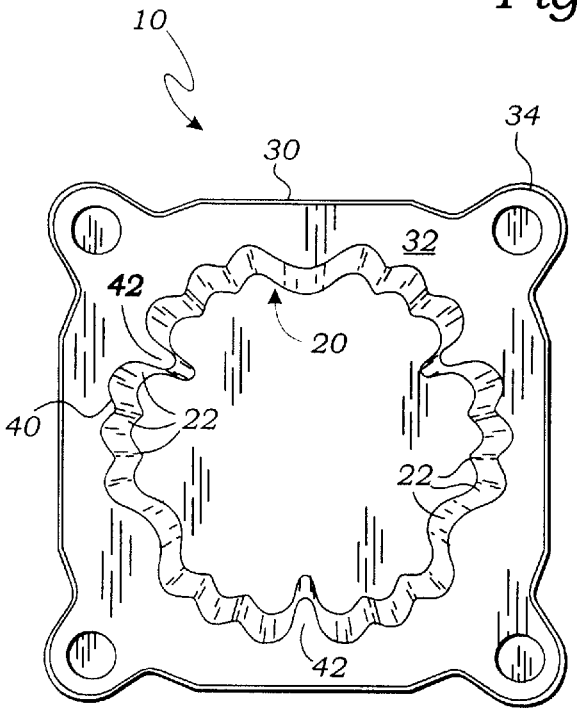
FIG. 2 is an end elevational view of the disposable handle according to the above preferred embodiment of the present invention.
Figure 3:
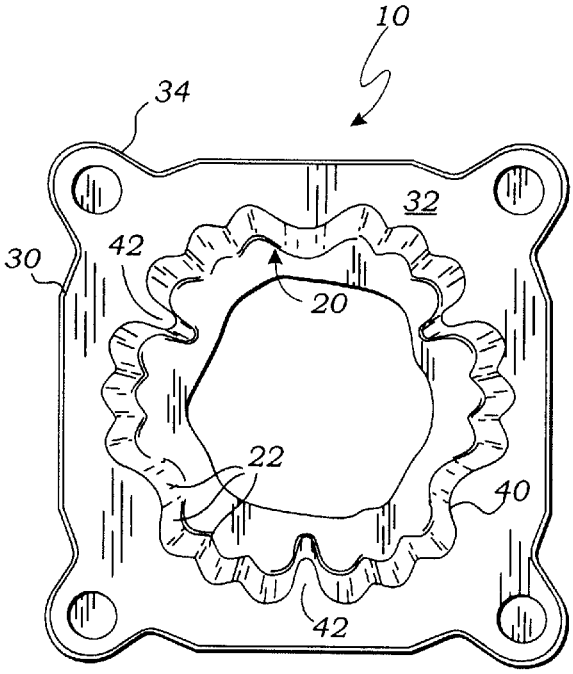
FIG. 3 is an end elevational view of a disposable handle for roll cores according to a first alternative mode of the above preferred embodiment of the present invention.
Figure 4:
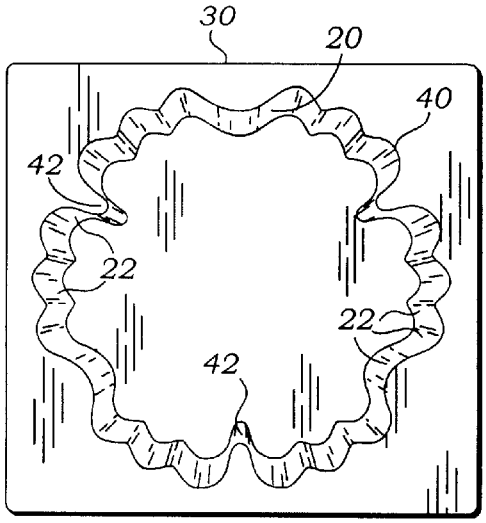
FIGS. 4 and 5 are end elevational views of a disposable handle for roll cores according to a second and third alternative modes of the above preferred embodiment of the present invention, having square and round flanges respectively.
Figure 5:
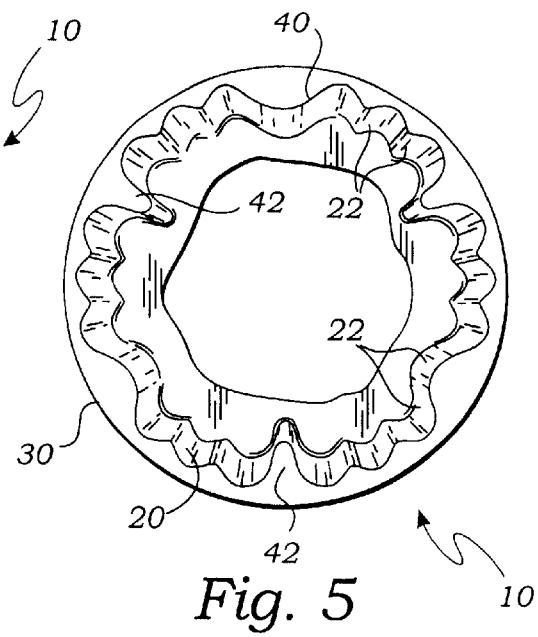
Figure 6:
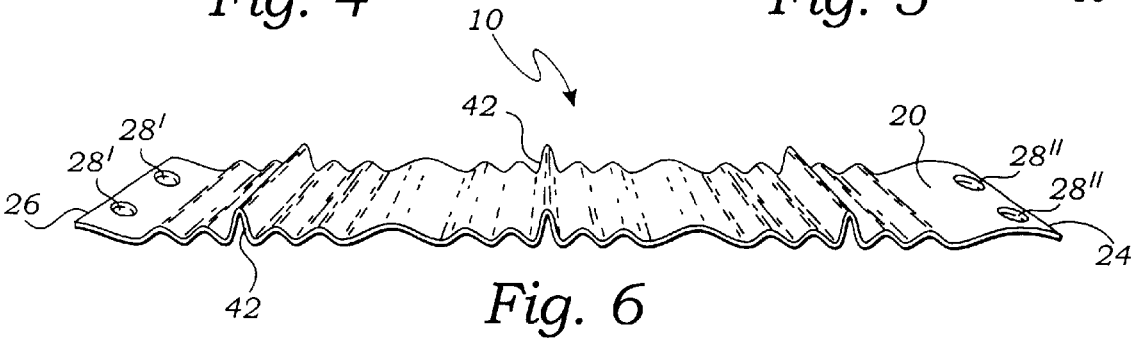
FIG. 6 is a perspective view of an unrolled disposable handle according to a fourth alternative mode of the above preferred embodiment of the present invention.

Preferably, the handle 10 further comprises an integral, outwardly directed flange 30 positioned at a proximal end of the holder body 20 and preferably provides a peripheral stiffening lip 32. This flange 30 preferably provides a plurality of integral spaced-apart corner ears 34 which extend radially outwardly, as clearly shown in FIGS. 1 to 3. Preferably, an integral end wall 40 is positioned at a distal end of the holder body 20, and may be fully closed (FIG. 4), or it may provide a finger access aperture (FIG. 5). The holder body 20 may include a seam 24 so it may be unrolled as is shown in FIG. 6. This seam preferably incorporates a means for sealing 26 the seam 24 such as the embossed dimples 28' and corresponding surface depressions 28" as shown in FIG. 6. When the holder body 20 is rolled-up as shown in FIG. 7, the embossed dimples 28' are pressed in to the surface depressions 28" to secure or fasten the parting seam 24.

Preferably a proximal portion 21 of the holder body 20 is generally non-tapered while a distal portion 23 of the holder body 20 is tapered inwardly. The distal tapered portion 23 is sized so that it provides a sliding fit within the roll core 50, and the proximal non-tapered portion 21 provides a compression fit within the roll core 50. To illustrate this, the inner diameter of certain standard core rolls is exactly 3 inches. Correspondingly, the holder body 20 is approximately 3 inches in length. The proximal portion 21 of the holder body 20 is preferably between 3 1/16 and 3 1/64 inches in diameter for a distance of about 1.5 inches from the flange 30 measured axially. For the distal portion 1.5 inches the holder body 20 tapers uniformly to 2¾ inches. Other dimensions may be used as well to achieve a handle that is easily slipped into the roll core and which is secured in it, as shown in FIGS. 1 to 10.

As shown in FIG. 8, the inventive device may comprise primarily the holder body 20 with circumferentially directed arcuate ribs 22 as previously stated. In this alternative mode, the flange 30 may comprise several small tabs 32. The compressive flexing of the holder body 20 when inserted into the roll core 50 is primarily accomplished when the stiffening ribs 42 move radially inwardly. This causes a strong spring force to apply gripping power to the interior of the roll core 52.

Figure 12:
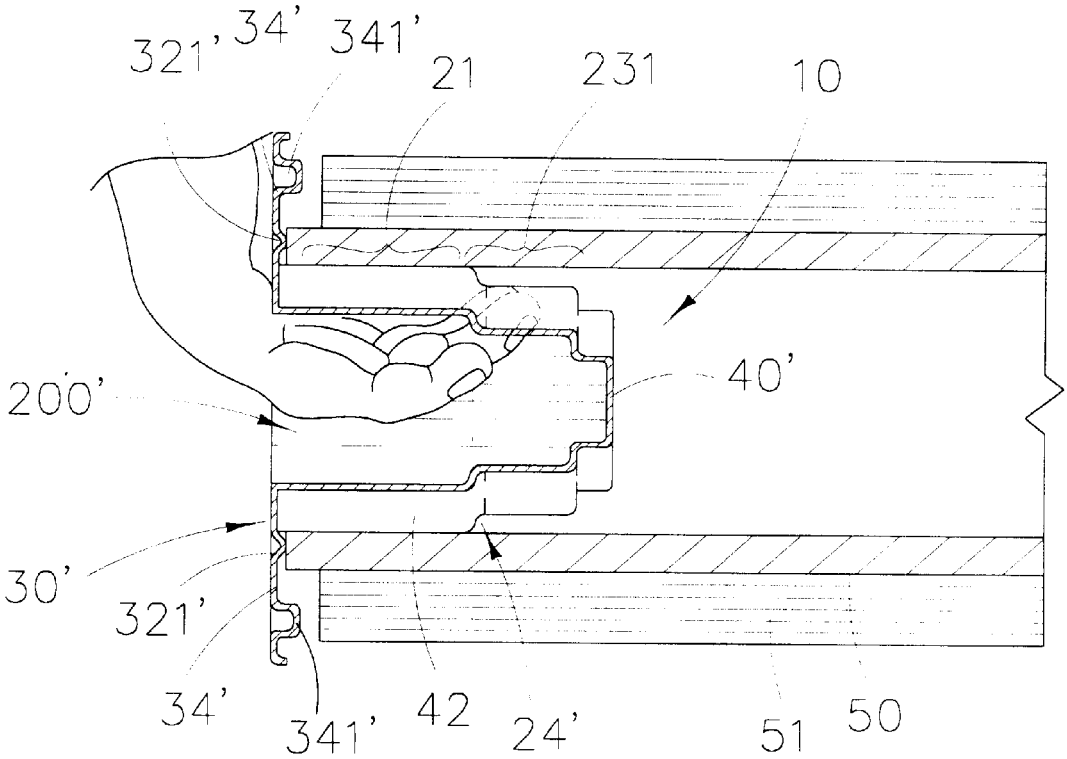
FIG. 12 is a sectional view of the disposable handle while supporting the roll core according to the above sixth alternative mode of the above preferred embodiment of the present invention.
Figure 11:
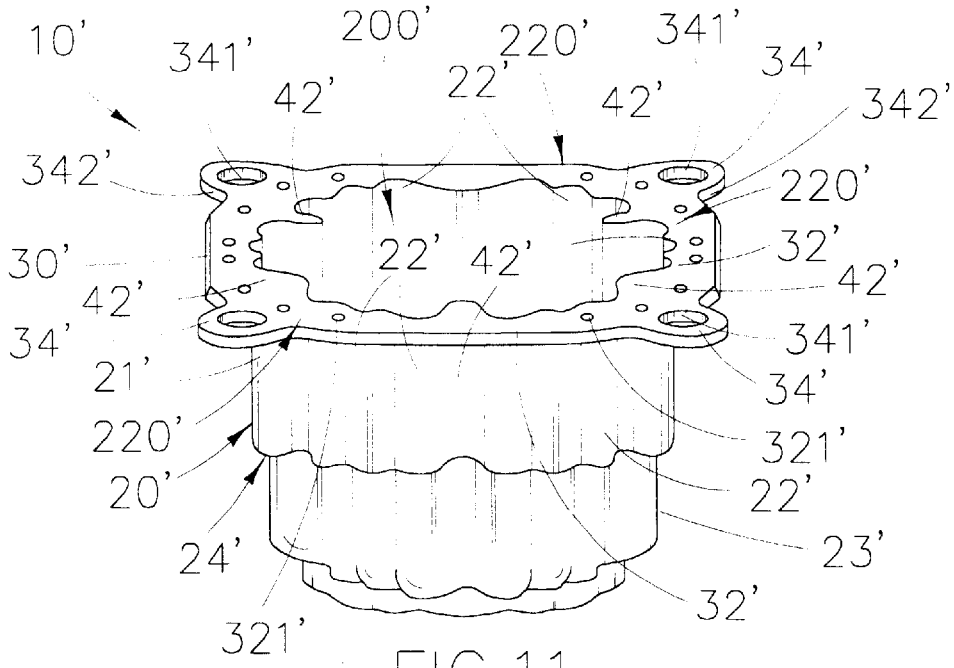
FIG. 11 is a perspective view of a disposable handle for roll cores according to a sixth alternative mode of the above preferred embodiment of the present invention.
Figure 13:
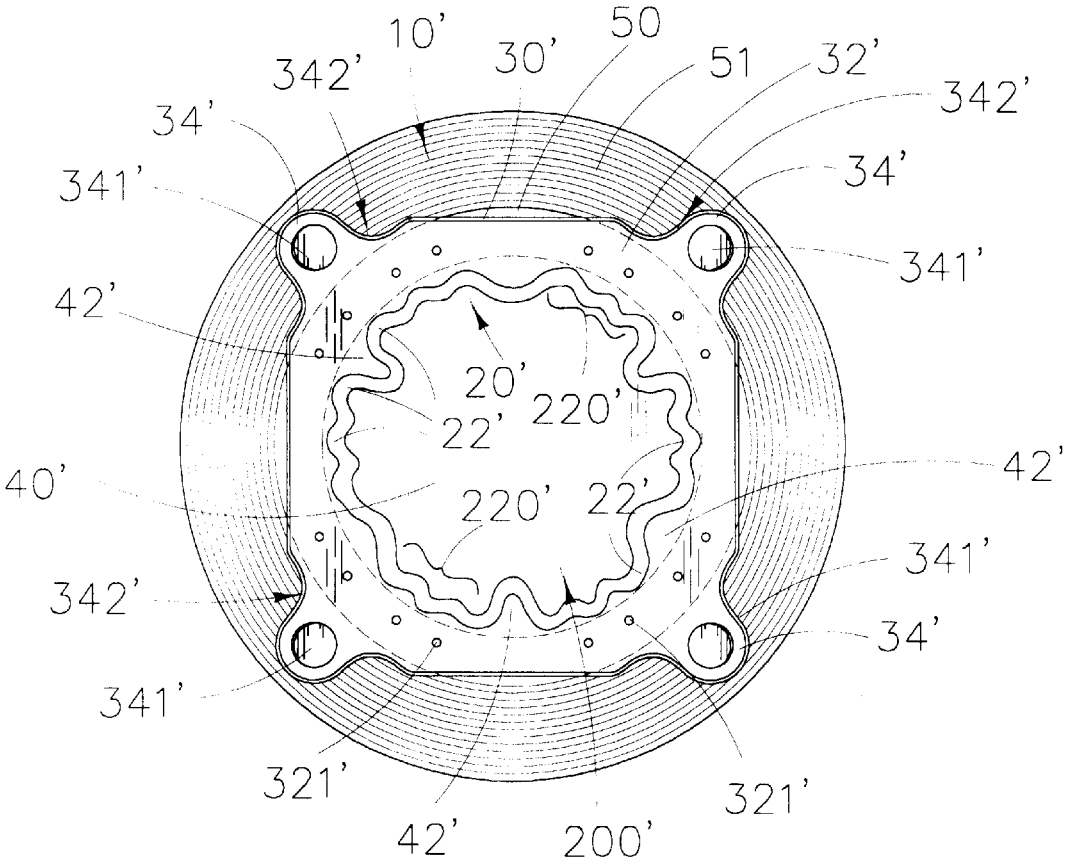
FIG. 13 is an end elevational view of the disposable handle while supporting the roll core according to the above sixth alternative mode of the above preferred embodiment of the present invention.

Referring to FIGS. 11 to 13, a disposable handle 10' for roll core 50 according to a sixth embodiment of the above preferred embodiment of the present invention is illustrated, wherein the handle 10' also comprises a hollow holder body 20' and a flange 30' radially and outwardly extended from a proximal end of the holder body 20' integrally.

Similarly, the holder body 20' is a generally circular side wall made by injection molding, vacuum forming or spin molding. The hollow holder body 20', which defines a handle chamber 200' extended from a proximal end to a distal end thereof, further has a plurality of side-by-side side wall arcuate segments 22' and a plurality of stiffening ribs 42' formed longitudinally around the holder body 20', wherein the stiffening ribs 42' are positioned spacedly apart that separate the plurality of arcuate segments 22' into groups of resilient rotor supports 220' adapted for compressive constraint within the roll core 50.

According to the preferred embodiment, there are totally six stiffening ribs 42' separating eighteen arcuate segments 22' into six rotor supports 220' equally spaced apart that each contains preferably three arcuate segments 22'. As shown in FIG. 13, the six rotor supports 220' substantially are in contact with more than 80% of the inner surface of the roll core 50 so as to well support the roll core 50 in a balanced manner. It is worth to emphasize that the three arcuate segments 22' of each group of rotor support 220' are constructed in continuous wave form to provide three arc-shaped smooth and round bearing surfaces, as shown in the FIGS. 11 and 13. When the holder body 20' of the handle 10' is fitted into the open end of the roll core 50, as shown in FIGS. 12 and 13, these bearing surfaces of the arcuate segments 22' function just like ball bearings that provides a frictionless smooth contact with respect to the inner surface of the roll core 50 while well supporting the roll core 50 substantially through such eighteen linear contacts of the accurate segments 22', so as to enable the roll core 50 to smoothly rotate about the handle 10'.

It should be noticed that, the depth of each of the stiffening ribs 42' must be deeper than the curvature of all the arcuate segments 22'. Such arrangement renders each of the stiffening ribs 42' effective to provide an outward spring bias deflection effect with respect to the neighboring rotor supports 220'. Such spring bias deflection effect enables the two groups of rotor supports 220' positioned at two sides of a particular stiffening rib 42' to move together to reduce the distance between the two rotor supports 220' so as to substantially reduce the outer diameter of the holder body 20' adapted for fitting into various sizes of roll core 50, varying from 2.989 inches to 3.060 inches. After the holder body 20' of the handle 10' fits into the open end of the roll core 50, the spring bias deflection effect of the stiffening ribs 42' also renders the rotor supports 220' movable away from each other to form a slightly gripping effect for gripping the roll core 50 interiorly at one of its ends. In addition, in compressing, each of the arcuate segments 22 may further flex to form a smaller curvature of arc, thereby diminishing the overall outer diameter of the holder body 20'.

In addition, the spring bias deflection effect of the holder body 20' of the present invention further achieves unexpected results as follows:

(i) The waved structure of the arcuate segments 22' and the stiffening ribs 42' structurally reinforce the holder body 20' radially to provide a stronger radial support to the roll core 50 while using a relatively thinner thickness of material so as to provide a minimum manufacturing cost, so that the users can afford to discard the handle 10' after use.

(ii) The vibration occurring during the rotation of the roll core 50 with respect of the handles 10' supported at two ends thereof can be absorbed by such spring bias deflection effect of the holder body 20' so as to prevent the vibration transferring to the user's hands.

(iii) The spring bias deflection effect also renders the holder body 20' capable of absorbing the pressure from the roll core 50, especially during the rotation of the roll core 50, so as to avoid unwanted injury to the finger joints of the user's hands.

It is worth to further explain that when the user pulls the film and rotates the film roll 51, the uneven pulling force may cause the roll core 50 vibrates up and down or left or right with respect to the user's hands. The vibrating force of the roll core 50 will substantially absorbed by moving the respective rotor supports 220' towards each other due to the spring bias deflection effect so that less vibration or shock will be transferred to the user's holding hands.

Like the above preferred embodiment and its first to fifth embodiments, the holder body 20' has a proximal portion 21 ' longitudinally extended from the flange 30' to a middle portion of the holder body 20' and a distal portion 23' longitudinally extended from the proximal portion 21' to the end wall 40' of the holder body 20' to form a supporting portion. The proximal supporting portion 21' is generally non-tapered so that the arcuate segments 22' are longitudinally extended parallel to the axis of the holder body 20' so that, as shown in FIGS. 10, 12 and 13, the bearing surfaces of the arcuate segments 22' of the rotor supports 220' of the holder body 20' are smoothly in linear contact with the inner surface of the roll core 50 for smooth rotation correspondingly and well supporting all around evenly.

Similarly, the proximal non-tapered portion 21' provides a compression fit within the roll core 50. For example, if the inner diameter of certain standard core rolls is exactly 3 inches. Correspondingly, the holder body 20' is approximately 3 inches in length. The proximal portion 21' of the holder body 20' is preferably made slightly bigger, such as between 3 1/16 and 3 1/64 inches, in diameter for a distance of about 1.5 inches from the flange 30' measured axially.

Figure 10:
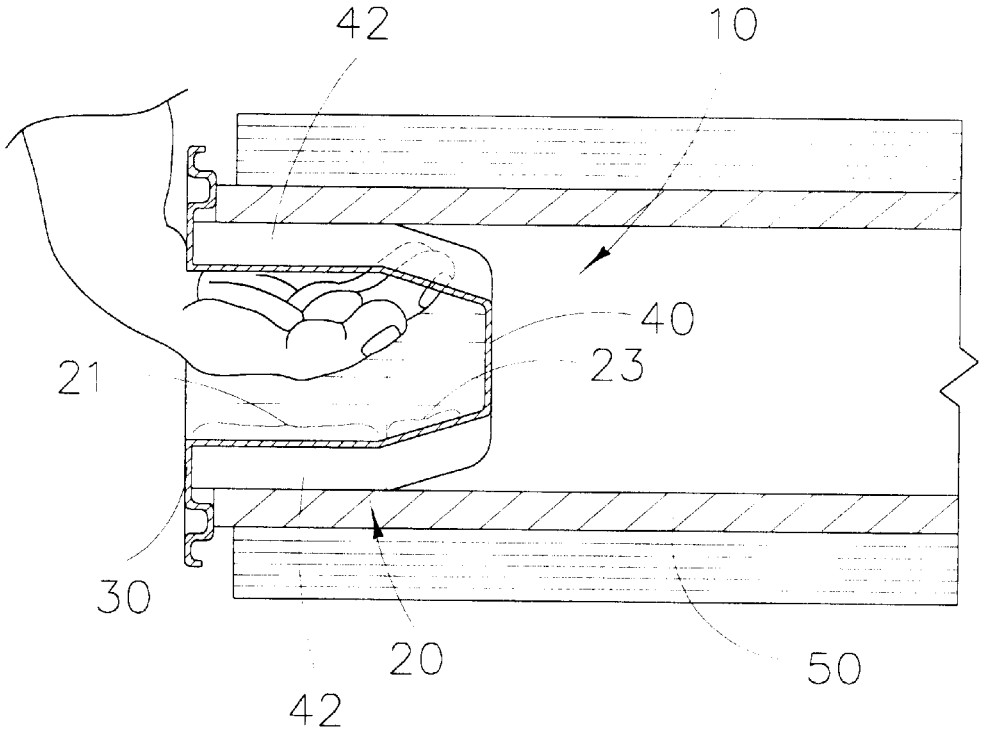
FIG. 10 is a sectional view of the disposable handle while supporting the roll core according to the above preferred embodiment of the present invention.

Alternatively, instead of having a tapered distal portion 23 as shown in FIG. 10, the distal portion 23' of the sixth alternative mode of the preferred embodiment equally reduces its outer diameter to form a finger-holder portion and defines a step shoulder 24' between the proximal supporting portion 21' and the distal finger-holder portion 23'. For example, the distal portion 23' which has a length of 1.5 inches preferably has an outer diameter of 2¾ inches uniformly.

Accordingly, the distal finger-holder portion 23' has a size smaller than the inner diameter of the roll core 50 so that a circumferential air gap is defined around the distal finger-holder portion 23' to provide a cushion effect such that the distal portion 23' has no substantial contact with the inner surface of the roll core 50 during the rotation of the roll core 50 with respect to the handles 10' supported at two ends thereof, as shown in FIG. 12. Therefore, the user's finger tips are capable of resting at the distal finger-holder portion 23' inside the holder body 20' while hand supporting the handles 10' and the roll core 50 to avoid heat being transferred to the user's hand and fingers directly and thus preventing getting burnt. Moreover, the distal finger-holder portion 23' also balances the strength of the fingers of the user so the holder body 20' can thus be pushed and held evenly.

As shown in FIGS. 11 to 13, the flange 30' of the handle 10' is an integral and outwardly extended peripheral wall positioned around a proximal end of the holder body 20'. The flange preferably provides a peripheral stiffening lip 32' and a plurality of integral spaced-apart corner ears 34' which extend radially outwardly at four corners respectively of the stiffening lip 32, as embodied in FIGS. 11 and 13. Also an integral end wall 40 is positioned at a distal end of the holder body 20.

Similarly to the above embodiment and its alternative modes, each of the corner ears 34' has an indention button 341' projected inwardly thereon to reinforce the corner ear 34'. Moreover, when such indention buttons may bias against the end side of the film roll 51 and/or roll core 50 so as to prevent the holder body 20' from being over inserted into the open end of the roll core 50 to ensure smooth rotation of the roll core 50 and to prevent the stiffening lip 32' to be engaged with the film roll 51 that may block the rotation of the roll core 50.

On the stiffening lip 32', a plurality of indented tips 321' are spacedly provided thereon, which not only reinforce the stiffening lip 32' but also are arranged to generally bias against the roll core 50 so as to ensure a smooth rotation of the roll core 50 with respect to the handles 10' and prevent the holder body 20' from being over inserted into the open end of the roll core 50.

Two claw notches 342' are formed at two sides of each of the comer ears 34' respectively, so that when the user uses his or her hand to hold the handle for rotatably supporting the roll core 50, the user's thumb can rest on the respective claw notch 342' to ensure firm gripping and holding of the handle 10' during the relatively rotation of the roll core 50.

In view of above, the handle 10, 10' enables holding a spinning or roll core 50 without finger contact so that friction bums are avoided. Due to the arrangement of the stiffening ribs 42, 42' between the arcuate segments 22, 22', the arcuate segments 22, 22' provide spring-like action which absorb vibration forces which would otherwise be passed to the hands. The low friction material used in construction of the invention enables the roll core 50 to slip as it rolls, yet also enables holding the roll core 50 securely.

The present invention is preferably light in weight such that the total weight is not significantly changed by using the handles 10, 10'. The holder body 20, 20' of the handle 10 is approximately 0.050 inch or less in thickness. Thus the cost of the handles 10, 10' is insignificant allowing them to be discarded after use that renders the handle 10 a disposable handle. The flanges may be used as a brake against the roll core 50, and otherwise protects the hands from bums.

While the prevent invention has been described with reference to at least one preferred embodiment, it is to be clearly understood by those skilled in the art that the present invention is not limited thereto. Rather, the scope of the invention is to be interpreted only in conjunction with the appended claims.

What is claimed is:

1. A handle for fitting into an open end of a roll core for supporting said roll core while said roll core is capable of rotating with respect to said handle, wherein said handle comprises:

a hollow holder body having a proximal end and an end wall, wherein said holder body is longitudinally divided into a proximal portion extended from said proximal end to a middle portion of said holder body and a distal portion extended from said proximal portion to said end wall, wherein said proximal portion has an outer diameter arranged for fitting into said open end of said roll core for rotatably supporting said roll core and said distal portion has an outer diameter smaller than that of said proximal portion for preventing direct contact with an inner surface of said roll core, wherein said holder body further has a plurality of side-by-side side wall arcuate segments longitudinally provided around said proximal portion for enabling said roll core to be smoothly rotated with respect to said holder body, wherein said arcuate segments are extended from said proximal end to said end wall, wherein said distal portion is tapered inwardly to provide a sliding fit for said open end of said roll core while said proximal portion is non-tapered to provide a compression fit for said open end of said roll core; and a flange radially and outwardly extended from said proximal end of said holder body integrally.

2. The handle, as recited in claim 1, wherein said flange of said handle is an integral and outwardly extended periphery wall positioned around a proximal end of said holder body, wherein said flange provides a peripheral stiffening lip and a plurality of integral spaced-apart corner ears which extend radially outwardly from said stiffening lip.

3. The handle, as recited in claim 2, wherein each of said corner ears has a indention button indented inwardly thereon to reinforce said corner ear and for biasing against an end side of said roll core for ensuring smooth rotation of said roll core.

4. The handle, as recited in claim 2, wherein a plurality of indented tips are spacedly provided on said stiffening lip to reinforce said stiffening lip and for ensuring smooth rotation of said roll core.

5. The handle, as recited in claim 3, wherein at least a claw notch is formed at one side of each of said corner ears to ensure firmly gripping and holding of said handle during rotation of said roll core.

6. The handle, as recited in claim 1, wherein said holder body further has a plurality of spaced-apart, axially-directed stiffening ribs formed longitudinally around said holder body to provide compressive flexing of said holder body, wherein said stiffening ribs are capable of moving radially inwardly to cause a strong spring force for applying gripping power to said roll core.

7. The handle, as recited in claim 5, wherein said holder body further has a plurality of spaced-apart, axially-directed stiffening ribs formed longitudinally around said holder body to provide compressive flexing of said holder body, wherein said stiffening ribs are capable of moving radially inwardly to cause a strong spring force for applying gripping power to said roll core.

8. The handle, as recited in claim 7, wherein each group of said rotor supports comprises two or more of said arcuate segments constructed in continuous wave form to provide arc-shaped smooth and round bearing surfaces for enabling said roll core to smoothly rotate about said handle.

9. The handle, as recited in claim 8, wherein each of said stiffening ribs has a depth deeper than a curvature of each of said arcuate segments, so as to provide an outward spring bias deflection effect with respect to said group of rotor supports adjacent to said respective stiffening rib.

10. A handle for fitting into an open end of a roll core for supporting said roll core while said roll core is capable of rotating with respect to said, handle, wherein said handle comprises:

a hollow holder body having a proximal end and an end wall, wherein said holder body is longitudinally divided into a proximal portion extended from said proximal end to a middle portion of said holder body and a distal portion extended from said proximal portion to said end wall, wherein said proximal portion has an outer diameter arranged for fitting into said open end of said roll core for rotatably supporting said roll core and said distal portion has an outer diameter smaller than that of said proximal portion for preventing direct contact with an inner surface of said roll core, wherein said holder body further has a plurality of side-by-side side wall arcuate segments longitudinally provided around said proximal portion for enabling said roll core to be smoothly rotated-with respect to said holder body, wherein said distal portion equally reduces said outer diameter thereof to form a finger-holder portion and defines a step shoulder between said proximal portion and said distal portion, thereby a circumferential air gap is defined around said distal portion to provide. a cushion effect that renders said distal portion has no substantial contact with said inner surface of said roll core during a rotation of said roll core with respect to said handle supported at said open end of said roll core; and a flange radially and outwardly extended from said proximal end of said holder body integrally.

11. The handle, as recited in claim 10, wherein said flange of said handle is an integral and outwardly extended periphery wall positioned around a proximal end of said holder body, wherein said flange provides a peripheral stiffening lip and a plurality of integral spaced-apart corner ears which extend radially outwardly from said stiffening lip.

12. The handle, as recited in claim 11, wherein each of said corner ears has a indention button indented inwardly thereon to reinforce said corner ear and for biasing against an end side of said roll core for ensuring smooth rotation of said roll core.

13. The handle, as recited in claim 11, wherein a plurality of indented tips are spacedly provided on said stiffening lip to reinforce said stiffening lip and for ensuring smooth rotation of said roll core.

14. The handle, as recited in claim 12, wherein at least a claw notch is formed at one side of each of said corner ears to ensure firmly gripping and holding of said handle during rotation of said roll core.

15. The handle, as recited in claim 10, wherein said holder body further has a plurality of stiffening ribs formed longitudinally around said holder body, wherein said stiffening ribs are positioned spacedly apart to separate said plurality of arcuate segments into groups of resilient rotor supports adapted for compressive constraint within said roll core.

16. The handle, as recited in claim 14, wherein said holder body further has a plurality of stiffening ribs formed longitudinally around said holder body, wherein said stiffening ribs are positioned spacedly apart to separate said plurality of arcuate segments into groups of resilient rotor supports adapted for compressive constraint within said roll core, wherein each group of said rotor supports comprises two or more of said arcuate segments constructed in continuous wave form to provide arc-shaped smooth and round bearing surfaces for enabling said roll core to smoothly rotate about said handle, wherein each of said stiffening ribs has a depth deeper than a curvature of each of said arcuate segments, so as to provide an outward spring bias deflection effect with respect to said group of rotor supports adjacent to said respective stiffening rib.

17. A handle for fitting into an open end of a roll core for supporting said roll core while said roll core is capable of rotating with respect to said handle, wherein said handle comprises:

a hollow holder body having a plurality of side-by-side side wall arcuate segments and a plurality of stiffening ribs formed longitudinally around said holder body, wherein said stiffening ribs are positioned spacedly apart to separate said plurality of arcuate segments into groups of resilient rotor supports adapted for compressive constraint within said roll core for enabling said roll core to be smoothly rotated with respect to said holder body, wherein each group of said rotor supports comprises two or more of said arcuate segments constructed in continuous wave form to provide arc-shaped smooth and round bearing surfaces for enabling said roll core to smoothly rotate about said handle; and a flange radially and outwardly extended from a proximal end of said holder body integrally.

18. The handle, as recited in claim 17, wherein each of said stiffening ribs has a depth deeper than a curvature of each of said arcuate segments, so as to provide an outward spring bias deflection effect with respect to said group of rotor supports adjacent to said respective stiffening rib.

19. The handle, as recited in claim 18, wherein said flange of said handle is an integral and outwardly extended periphery wall positioned around a proximal end of said holder body, wherein said flange provides a peripheral stiffening lip and a plurality of integral spaced-apart corner ears which extend radially outwardly from said stiffening lip.

20. The handle, as recited in claim 19, wherein each of said corner ears has a indention button indented inwardly thereon to reinforce said corner ear and for biasing against an end side of said roll core for ensuring smooth rotation of said roll core.

21. The handle, as recited in claim 19, wherein a plurality of indented tips are spacedly provided on said stiffening lip to reinforce said stiffening lip and for ensuring smooth rotation of said roll core.

22. The handle, as recited in claim 20, wherein at least a claw notch is formed at one side of each of said corner ears to ensure firmly gripping and holding of said handle during rotation of said roll core.

23. A roll core supporting apparatus comprising:

a pair of cylindrical handles, each of said handles having a generally circular side wall, said side wall comprising a plurality of side-by-side arcuate segments adapted for outward spring bias deflection for gripping a roll core interiorly at one end thereof, wherein said side wall. provides an axially directed seam enabled for parting said side wall; and means for sealing said axially directed seam.

* * * * *